US006997526B2

(12) United States Patent
Leimkuehler et al.

(10) Patent No.: US 6,997,526 B2
(45) Date of Patent: Feb. 14, 2006

(54) REFRIGERATOR DOOR STORAGE SYSTEMS

(75) Inventors: Scott W. Leimkuehler, Swisher, IA (US); Eric K. Silbaugh, Cedar Rapids, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/314,703

(22) Filed: Dec. 9, 2002

(65) Prior Publication Data

US 2004/0108799 A1 Jun. 10, 2004

(51) Int. Cl.
*A47B 96/04* (2006.01)

(52) U.S. Cl. ..... 312/321.5; 312/405.1

(58) Field of Classification Search ..... 312/321.5, 312/404, 405.1, 408
See application file for complete search history.

(56) References Cited

U.S. PATENT DOCUMENTS

| | | | | |
|---|---|---|---|---|
| 2,898,173 A | | 8/1959 | Squire | |
| 3,029,953 A | * | 4/1962 | Morrissey, Jr. | 312/321.5 |
| 3,817,395 A | | 6/1974 | LeFever | |
| 4,279,397 A | | 7/1981 | Larsson | |
| 4,859,010 A | * | 8/1989 | Jeziorowski | 312/321.5 |
| 4,908,544 A | * | 3/1990 | Lau | 312/321.5 |
| 4,921,315 A | * | 5/1990 | Metcalfe et al. | 312/321.5 |
| 5,004,305 A | * | 4/1991 | Montuoro et al. | 312/405.1 |
| 5,193,892 A | | 3/1993 | Swindel | |
| 5,199,277 A | | 4/1993 | Granstrom et al. | |
| 5,226,717 A | | 7/1993 | Hoffman | |
| 5,322,366 A | | 6/1994 | Revlett et al. | |
| 5,346,299 A | * | 9/1994 | Werkmeister et al. | 312/405.1 |
| 5,370,455 A | | 12/1994 | Sedovic et al. | |
| 5,375,924 A | * | 12/1994 | Pohl et al. | 312/405.1 |
| 5,513,910 A | | 5/1996 | Ellingwood et al. | |
| 5,685,624 A | | 11/1997 | Lee | |
| 6,231,146 B1 | * | 5/2001 | Dang | 312/405.1 |
| 6,799,818 B1 | * | 10/2004 | Ahmed et al. | 312/405.1 |

FOREIGN PATENT DOCUMENTS

| | | |
|---|---|---|
| FR | 1.116.644 | 12/1954 |

* cited by examiner

*Primary Examiner*—Peter R. Brown
(74) *Attorney, Agent, or Firm*—McKee, Voorhees & Sease, P.L.C.

(57) ABSTRACT

Devices and methods for reversibly securing a shelf trim piece or the like to a refrigerator door panel. The shelf securing arrangement does not require holes to be disposed in the door panel. A positive snap-lock securement is provided.

74 Claims, 4 Drawing Sheets

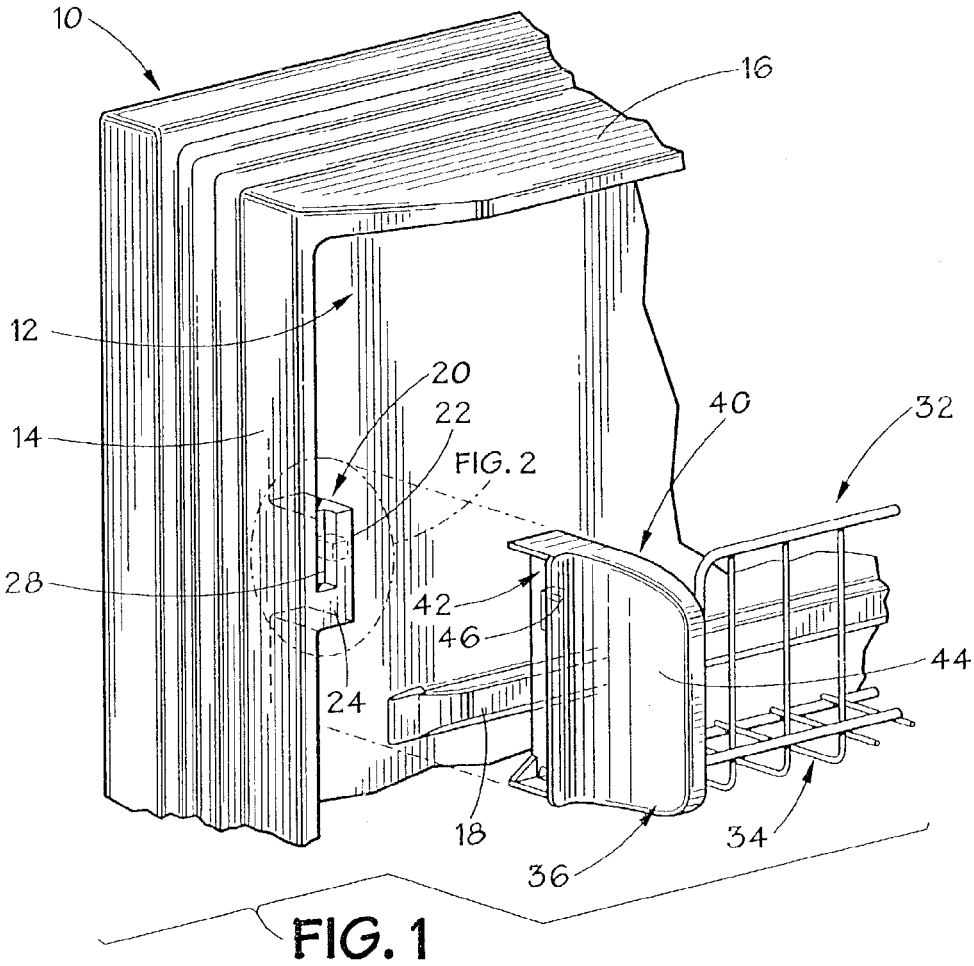
FIG. 1
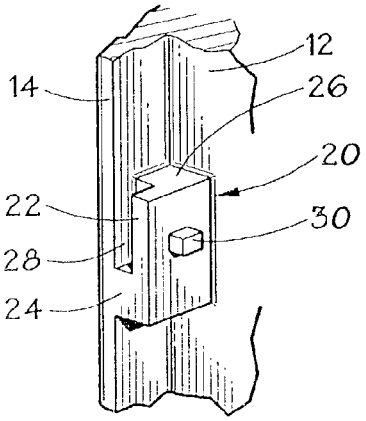
FIG. 2
FIG. 3
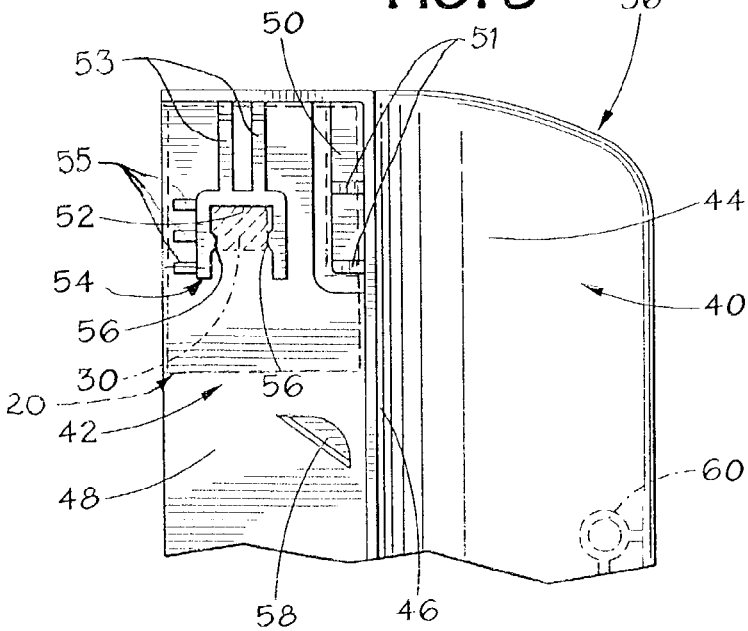

FIG. 4
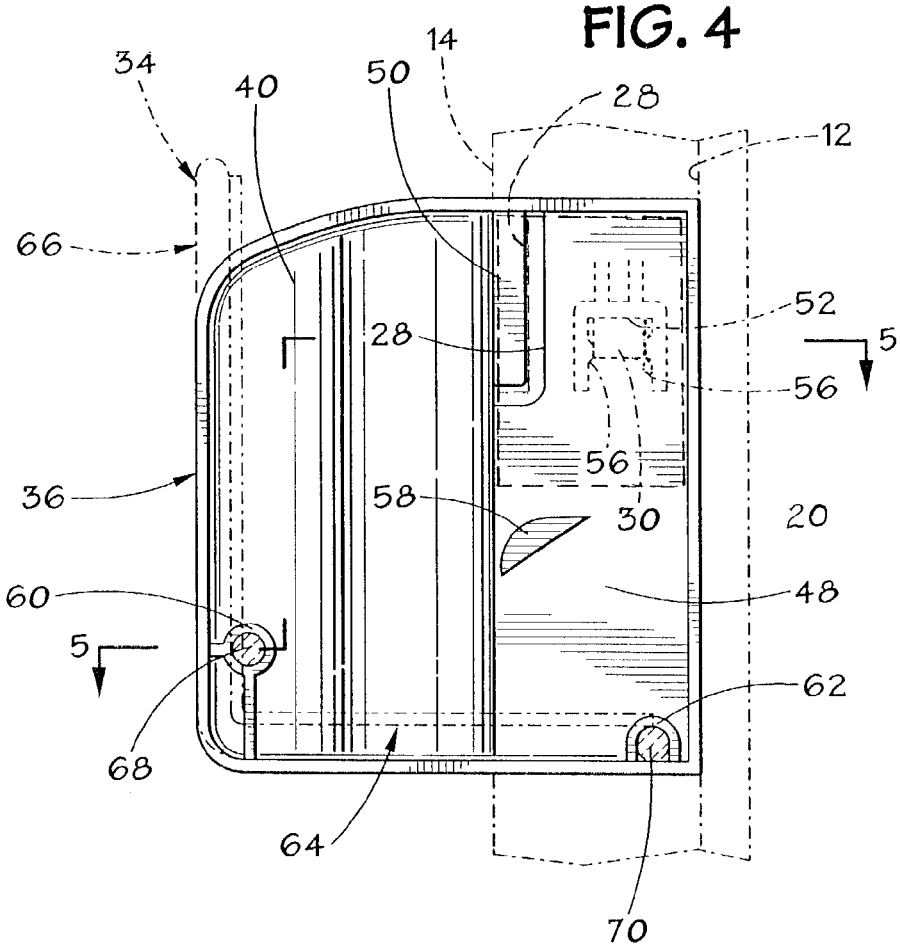
FIG. 6
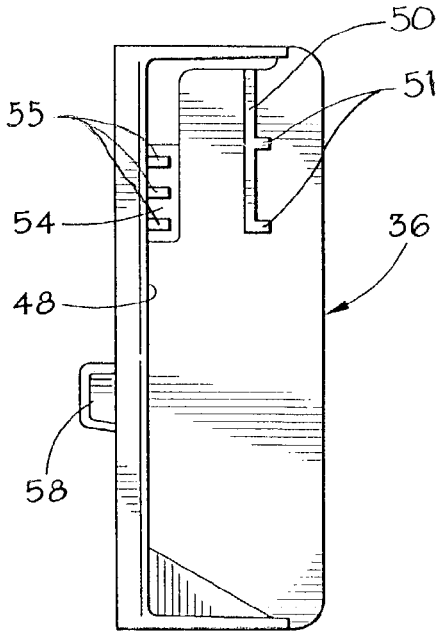
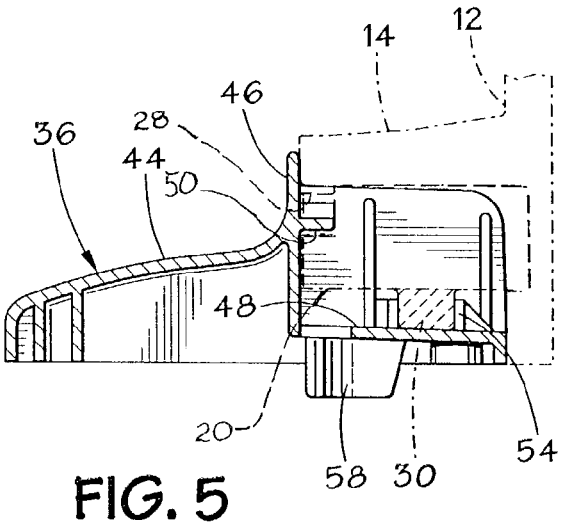
FIG. 5

FIG. 7
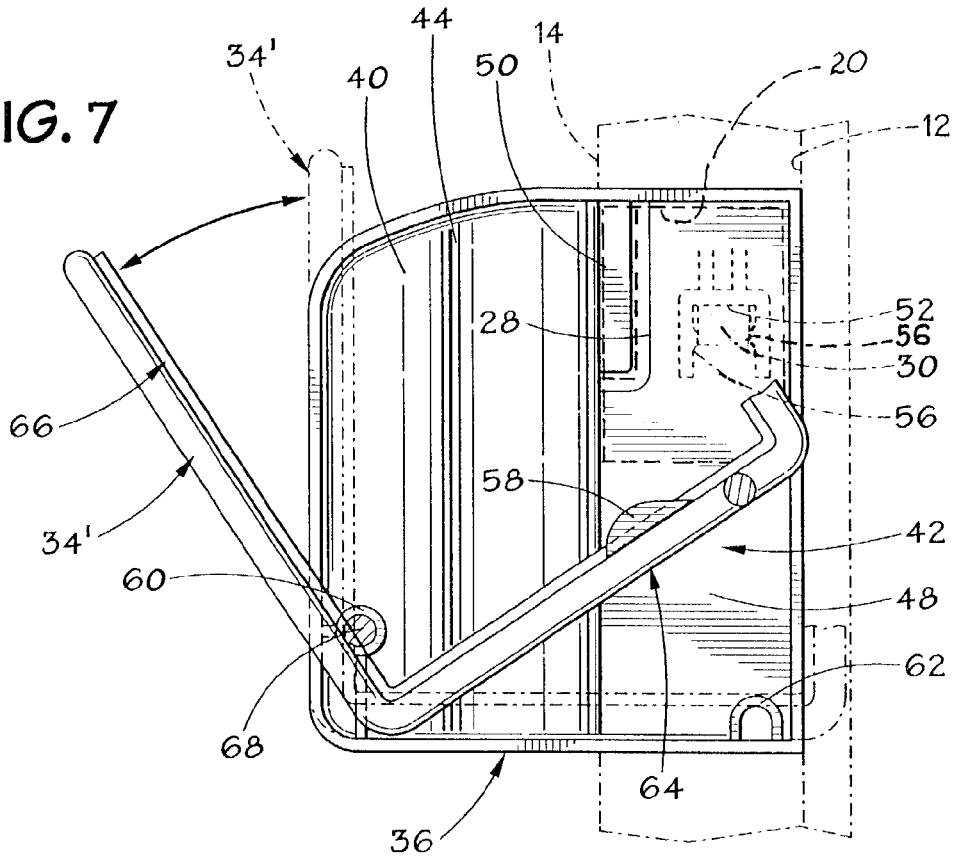
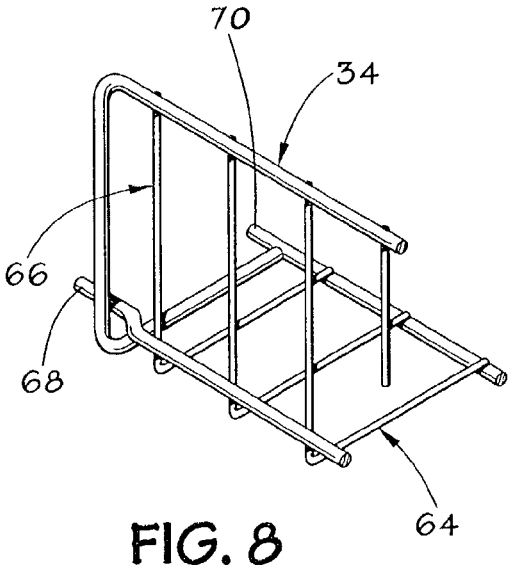
FIG. 8
FIG. 9
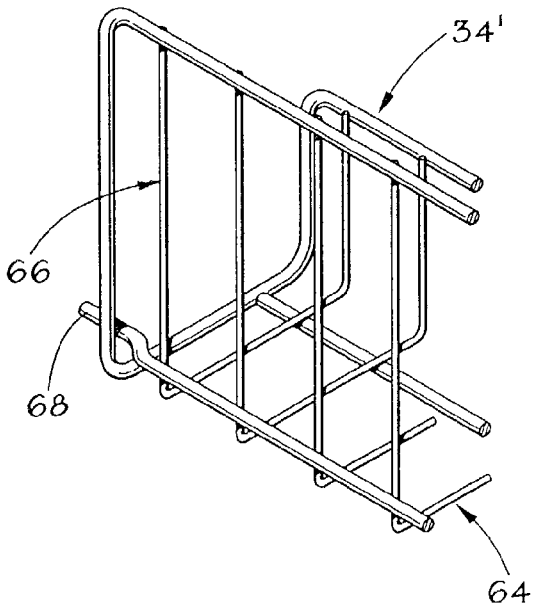

REFRIGERATOR DOOR STORAGE SYSTEMS

BACKGROUND OF THE INVENTION

1. Field of the Invention

The invention relates generally to storage systems for refrigerator doors and, in particular aspects, to devices and methods for affixing panels, shelves, retainers, and the like to an interior portion of a refrigerator door. In other particular aspects, the invention relates to an outwardly tiltable shelf or basket assembly for use in a refrigerator door.

2. Description of the Related Art

Contemporary refrigerators have doors that are equipped with shelves and storage areas where food items may be placed and conveniently accessed. Although interior door storage systems have been used for a long time, there remains a need for acceptable arrangements for reversibly securing associated components to the door panel. These components include shelves, baskets and trim.

Storage systems are known that require slots or apertures to be placed in the door panel. Complimentary-shaped pins on the storage shelf slide into the slots. Such a system is described in U.S. Pat. No. 5,042,398 issued to Lau, et al. Another example is found in U.S. Pat. No. 5,160,191 issued to Holland, et al. This type of securing arrangement is undesirable since the slots form a point of weakness in the door panel. Over time, cracks can develop around the slots leading to an eventual failure. Further, an opening through the door panel is also undesirable since moisture can enter the opening and can lead to mold and fungus growth within the door resulting in unpleasant smells and generally unhealthy conditions. Also, with a foam-in-place door construction, any opening would provide a leakage path.

An alternative shelf support system is described in U.S. Pat. No. 5,322,366 issued to Revlett, et al. A shelf trim piece is reversibly secured to an interior refrigerator door panel using a snap-fit connection. The snap-fit connection is formed between sidewardly extending projections located on interior door dikes and the end caps of the trim piece. Each of the end caps has a deformable end wall with a ramped portion and an opening disposed therein. The trim piece is attached to the door panel by aligning the end caps with the door dikes and then sliding the trim piece horizontally toward the door panel. As the ramped portions of the end walls contact the projections on the dikes, the end walls are temporarily deformed to move the openings in the end walls over the projections in a snap-fit manner. To remove the trim piece, one must pull the end wall sideways and then slide the trim piece horizontally away from the door panel.

This type of arrangement is problematic. The use of a deformable end wall together with an opening presents a structural weak point in the trim piece. The end wall may be easily broken off, particularly during the operation of removing the trim piece from the door liner. This is especially true in reduced wall thickness liners that are now prevalent and necessary to form a channel for mounting a dart-type door gasket.

U.S. Pat. No. 5,370,455 issued to Sedovic, et al. describes a refrigerator door storage assembly wherein a shelf module contains a pair of generally L-shaped slots on either lateral side. The liner of the refrigerator door has bosses that nest within the slots when the shelf module is placed onto the door liner. This arrangement is also not optimal. The nesting arrangement, while permitting a user to easily remove the module, is not secure enough in practice. Significant jolts to the door may cause the module to become dislodged, and children can too easily remove the modules.

Also, the process of removing a large object, such as a carton of milk, from below the module, may inadvertently release the module from the door. Undesirable lateral movement of the shelf module is also possible.

Some shelf, basket, or retainer connection arrangements utilize structure which extends forwardly of the door liner dikes. This can present issues and problems when trying to design a door liner for use with different types of doors (e.g. hinged, pullout), or different types of baskets, shelves, retainers, etc, or for different models of refrigerators (refrigerators or freezers). It can be desirable to avoid or minimize such forward extensions. Doing so can be advantageous to provide clearance to parts and minimize space taken for retaining geometry. It can also facilitate interchangeability for different styles and models of refrigerators, thus reducing capital expenses in design and manufacturing. Similarly, it can be desirable to avoid or minimize structure which extends inwardly from the edges of the door liner or the door liner dikes.

An improvement that addresses the problems of the prior art would be desirable.

It is within the context of the problems and concerns previously described that a need for improvement in the art exists. There is a need for a system that can be used to support from the door liner both a structure such as a retaining member, shelve, or basket, and the weight of items placed on the same, and which provides sufficient strength and is durable. Further needs exist regarding a system that can be locked in place, but is easy to remove, yet occupies a minimum amount of space.

SUMMARY OF THE INVENTION

Devices and methods are described for reversibly securing a shelf trim piece or the like to a refrigerator door panel. The shelf securing arrangement does not require holes to be disposed in the door panel. A positive snap-lock securement can be provided. In described embodiments, a flush-mount flange member is provided that adjoins the door dike to provide an indication of proper horizontal alignment as well as an aesthetically pleasing appearance.

In a preferred embodiment, a tilt-out shelf or basket arrangement is reversibly secured to the interior of a refrigerator door. The shelf or basket has a pair of end caps that are reversibly secured to dikes on the door panel. The vertical dikes of the door panel have specially-shaped mounting portions that can include laterally projecting bosses. The mounting portions can be configured to be formed in the door liner in relatively low profile, both relative to forward or inward (medial) directions from the dike. The door panel also can have a horizontally disposed support that can adjoin the lower edge of the basket or shelf.

In a preferred embodiment, each end cap has a boss contacting portion that includes a vertically oriented, generally U-shaped channel that is open at its lower end. The channel is shaped and sized to be complimentary to the boss and contains a raised bump so that when the boss is inserted into the channel a positive snap-lock securement is achieved. The end caps may be removed from the door panel by reversing this process.

A number of alternative basket, shelf, or other retainer assemblies are described that may be used with the end cap securing arrangement of the present invention. In one instance, a wire holding area is fixedly secured between the end caps while, in another, a wire holding area may be forwardly and rearwardly tilted with respect to the end caps. In a further arrangement, a plastic molded shelf having the end cap support geometry molded in place, can be used.

BRIEF DESCRIPTION OF THE DRAWINGS

FIG. 1 is an isometric, exploded view of a portion of the interior side of a refrigerator freezer door with a basket having a removably affixable end cap constructed in accordance with the present invention.

FIG. 2 depicts a portion of one of the door dikes to which an end cap is reversibly affixed.

FIG. 3 is an exterior side view of an exemplary end cap and in ghost lines illustrating a snap-fit connection with part of the mounting structure on the door liner.

FIG. 4 is an interior side view, partially in phantom, of a fixed wire basket assembly in secured relation to a door dike.

FIG. 5 is a cross-sectional cutaway view taken along the lines 5—5 in FIG. 4.

FIG. 6 is a back end-on view of the end cap shown in FIGS. 3, 4 and 5.

FIG. 7 is an interior side view of a tiltable basket assembly secured to the interior of the freezer door.

FIG. 8 illustrates, in isolation, a portion of the fixed basket assembly.

FIG. 9 depicts, in isolation, a portion of the tilt-out basket assembly.

DETAILED DESCRIPTION OF THE PREFERRED EMBODIMENTS

Figure 10:
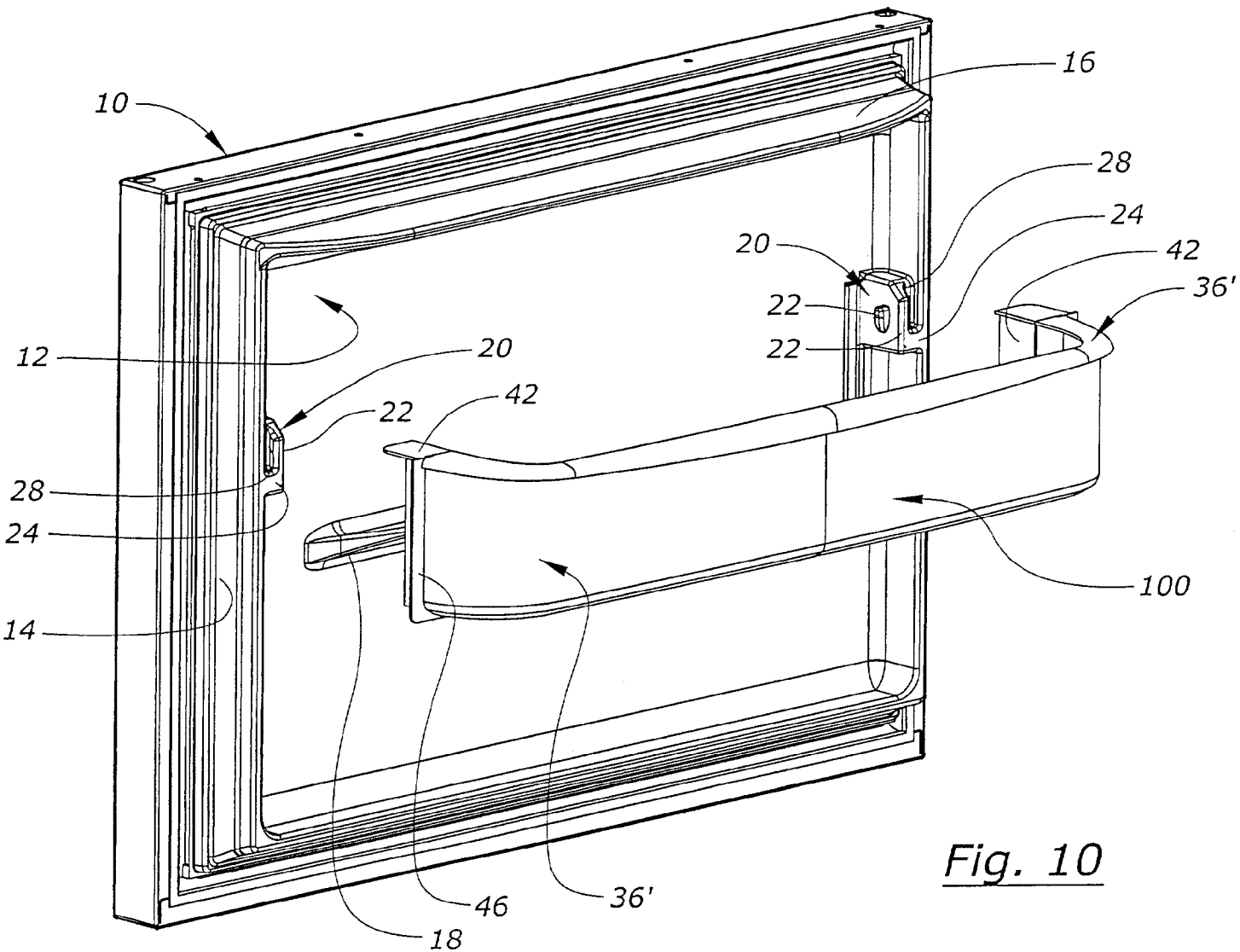
FIG. 10 illustrates a single piece molded embodiment incorporating the end cap geometry of FIGS. 1–7 at both opposite lateral ends.

FIGS. 1, 2, 4 and 7 illustrate the interior side of an exemplary refrigerator door 10 of the type used for the freezer section of a domestic refrigerator unit having a lower freezer compartment and an upper refrigeration compartment. The door 10 to the freezer compartment is shown in the open position and having an inner plastic liner 12. It is noted that, while the invention is being described with respect to use with the door to a freezer compartment, it could as easily be utilized with the door to a refrigeration compartment. The plastic liner 12 has outwardly protruding vertical and horizontal door dikes 14 and 16 around the periphery of the liner 12. It is noted that only one vertical dike 14 and one horizontal dike 16 is shown. However, in actuality, these dikes 14 and 16 completely surround the periphery of the liner 12 (see, e.g., FIG. 10). Therefore, it should be understood that a second dike (not shown in FIGS. 1–9) similar to dike 14 is located on the opposite lateral side of the door 10. The inner liner 12 also includes a horizontal support ledge 18. The support ledge 18 extends most of, but not all of the way across the width of the door liner 12.

A rectangular mounting portion (one shown at 20) is located on the liner 12 adjacent each vertical dike 14. The mounting portion 20 includes a vertically disposed rectangular plate 22 that is disposed in a parallel relation to the dike 14. The plate 22 is joined to the inner surface of the dike 14 by a bottom web 24 along its lower edge and a lateral web 26 (see FIG. 2) along its rear edge. A recess 28 is formed at the forward edge of the portion 20, being defined between the dike 14 and the plate 22. A boss or lug 30 projects inwardly from each mounting portion 20. Each boss 30 has a generally rectangular shape with rounded corners.

Mounting portion 20, including boss 30, can be molded and an integral part of door liner 12, and in particular dike 14 of door liner 12. As such, it can be plastic. Mounting portion 20 here is low profile in the sense it does not project forwardly ahead of dike 14, and does not extend very much inwardly or medially towards the dike on the other side of door liner 12 (e.g. an inch or less).

A basket assembly 32 is removably mountable to the liner 12 of the door 10 in order to retain food items within the door 10. The basket assembly 32 is made up of a wire frame holding portion with an end cap (one shown in FIG. 1) at either lateral end. There are two alternative embodiments for the wire frame holding portion described herein. FIG. 4 illustrates a fixed basket assembly 32 wherein the wire frame holding portion 34 is secured to the end caps 36 so that it does not move respect to the end caps 36. The wire frame holding portion 34 is shown apart from other components in FIG. 8. FIG. 7 depicts an alternative basket assembly 32' wherein the end caps 36 retain between them wire frame holding portion 34' that is tiltably moveable with respect to the end caps 36. The wire frame holding portion 34' is shown apart from other components in FIG. 9.

The construction of an exemplary end cap 36 is shown in FIGS. 3, 4, 5, 6 and 7. The end cap 36 is typically a unitarily molded plastic body that includes a forward decorative, or aesthetic, plate portion 40 and a rearward securing portion 42. The aesthetic plate portion 40 presents a curved outer face 44 which, as FIG. 5 shows best, provides a forward facing surface 46 located at the rear part of the aesthetic plate portion 40. The rear securing portion 42 of the end cap 36 features a plate member 48 that is shaped and sized to adjoin the plate 22 of the securing portion 20. The rearward side of surface 46 has a shaped tab 50 that is integrally formed with it. The tab 50 is shaped and sized to reside within the recess 28 in a downwardly sliding relation when the end cap 36 is secured to the liner 12. As shown in FIGS. 3, 5, and 6, tab 50 in this example has a main planar portion generally parallel to plate 48, but has several perpendicular ribs 51 that also fit within recess 28 (such that tab 50 and ribs 51 preferably frictionally fit therein). Ribs 51 can assist in strengthening tab 50. In addition, a substantially U-shaped channel 52 is formed out of raised ridges 54 that project outwardly from the plate member 48. The interior of the U-shaped channel 52 includes a pair of bumps 56 (see FIG. 3) that can extend substantially from wall 48 outwardly to the outer edges of raised ridges 48 and can be rounded in profile. Strengthening ribs 53 and 55 can be used to deter flexing of and strengthen ridges 48 defining U-shaped channel 52.

The channel 52 is shaped and sized to receive therein the boss 30 of the mounting portion 20 of the door liner 12. The bumps 56 restrict passage of boss 30 into and out of the channel 52 in order to create a snap-fit entry. The distance between the adjacent-most parts of bumps 56 on opposite sides of channel 52 is less than the widest width of boss 30. Boss 30 can have a opposite forward and rearward substantially flat faces defining the widest width of boss 30. But the lower edges of those opposite sides can be rounded or even tapered inwardly (see, e.g., FIG. 10). As boss 30 moves into channel 52, boss 30 interference fits through bumps 56, which move slightly outward by slight flexing of ridges 54. Bumps 56 can be positioned so that when boss 30 is fully inserted into channel 52, (FIG. 3), the flat opposite faces of boss 30 have moved past bumps 56 and thus boss 30 "snaps" into channel 52 in a basically locked position. Alternatively, bumps 56 could be positioned and configured to hold boss 30 in an interference type fit in channel 52.

The fit of boss 30 into channel 52 is illustrated in FIGS. 3, 4, 5, and 7. For clarity in the drawings, recess 28 of mounting portion 20 is shown in ghost lines, indicating generally the fit of tab 50 and ribs 52 into recess 28. The shape and location of tab 50/ribs 51 are shown in detail in FIGS. 3–7. The shape and location of recess 28 are shown in detail the FIGS. 1 and 2. It is to be understood that when end cap 36 is installed on mounting portion 20, tab 50 enters recess 28 and boss 30 on door dike 14 enters channel 52 on end cap 36 until boss 30 is seated and captured in channel 52. Tab 50 is also seated and substantially captured in recess 28.

The plate member 48 of the end cap 36 includes an inwardly projecting stop member 58. The lower end of the plate member 48 also contains two circular retaining recesses 60, 62 that are visible in FIGS. 4 and 7.

Turning now to FIGS. 8 and 9, the end portions of two alternative wire holding baskets 34, 34' are shown. These two baskets provide examples of the food retaining structures that may be used with the end caps 36 as part of a refrigerator shelf assembly. The two exemplary baskets 34, 34' are constructed in essentially the same manner using metal stock that has been welded at intersections to form the basket. Each basket 34, 34' includes a floor portion 64 and a wall portion 66. When the basket 34 or 34' is secured to the liner 12, food items are placed on the floor portion 64, and the wall portion 66 prevents the food items from falling off the floor portion 64. The wire basket 34, which is retained between two end caps 36 in a secured, non-movable relation, has a laterally-protruding rod portion 68 proximate the intersection of the floor portion 64 and the wall portion 66. In addition, there is a second laterally protruding rod portion 70 located proximate the rear of the floor portion 64. Again, it is pointed out that only one end of the wire basket 34 is shown in FIG. 8, and the opposite end of the wire basket, which is not shown, will have the same protruding portions. The wire basket 34 is affixed to an end cap 36 in the manner illustrated in FIG. 4 wherein the rod portion 68 is seated within the circular recess 60 and the rod portion 70 is seated within the circular recess 62.

The tiltable wire basket 34', as FIG. 9 shows, has a laterally protruding rod portion 68 located proximate the intersection of the floor portion 64 and the wall portion 66. However, there is no protruding rod portion 70. The wire basket 34' is secured to each end cap 36 as illustrated in FIG. 7. The rod portion 68 is seated within the circular opening 60 of each end cap 36 and the wire basket 34' can be tilted forwardly and outwardly with respect to the end caps 36 using the rod portions 68 as a pivot point, as illustrated in FIG. 7. As the basket 34' is tilted outwardly, the stop member 58 of each end cap 36 will eventually engage the floor portion 64, thereby limiting the amount by which the wire basket portion may be outwardly tilted. Use of a single end cap design that can accommodate both a fixed-relation and tiltable basket easily is advantageous.

In order to removably secure a basket assembly 32 or 32' to the liner 12, each end cap 36 is moved rearwardly onto the mounting portion 20 of the door dike 14. The end cap 36 is then moved downwardly so that the tab 50 is slid into the recess 28. In addition, the boss 30 of the mounting portion 20 enters the channel 52 of the end cap 36 in a snap-fit manner as the boss 30 is forced over or past the two bumps 56. Thus, a secure fit is provided by both the snap-fit mechanism provided by the channel 52 and boss 30 as well as the engagement of the tab 50 within the recess 28. Lateral movement of the basket assembly 32 or 32' is limited by the frictional engagement and trapping of the tab 50 within the recess 28. So is downward, frontward, and rearward movement. Upward movement is possible only if the snap-fit is overcome. Also, tabs 50 in recesses 28 deter lateral, downward, and rearward movement. The nature of restricting the gap width of entry into channel 52 with, for example, one or more bumps 56, provides a snap-fit retention or frictional retention that essentially locks end cap to the mounting portion. The end cap can be released by overcoming frictional retention or providing enough force to back the boss out of the snap-fit retention. This provides for a relatively low profile locking but easy release and removal without complex structure or utilizing deformable or deflecting pieces, such as described with regard to the prior art, which could over time break or cease to function properly. The forward-facing surface 46 of the end caps 36 provides a flush-mount flange that provides an aesthetically pleasing appearance. The rear end of the floor portion 64 of each wire basket 34, 34' rests on the horizontal support ledge 18 of the liner 12.

FIG. 10 illustrates in perspective view an alternative example of reversible securement of a structure to door 10. Here a one-piece molded plastic shelf 100 includes end caps 36 at opposite ends, but integrally formed therein, such that shelf 100 and end caps 36 comprise an integral one-piece apparatus. Vertical mounting structures, as previously described, receive corresponding mounting structure of end caps 36' (e.g. tab 50, U-shaped channel 52) to support and snap-fit rear securing portions 42 on opposite ends of shelf 100 to mounting portions 20 on opposite sides of liner 12 of door 10.

FIG. 10 therefore illustrates how a different structure can be releasably mounted with such mounting configuration. The structure can be of variety of things. Examples are baskets, shelves, or retaining members. The structure can also be support structure for any of a basket, shelf, or retaining member. As shown, the structure can be multi-pieced (e.g. the end caps separate from the basket, shelf, or retaining member), or can be integrated, including being one-piece (e.g. end cap and basket, shelf, or retaining member one-piece).

Those of skill in the art will recognize that many changes and modifications may be made to the devices and methods of the present invention without departing from the scope and spirit of the invention. Thus, the scope of the invention is limited only by the terms of the claims that follow and their equivalents.

What is claimed is:

1. A door retainer assembly for retaining food items in a refrigerator unit, comprising:

a door liner having a generally vertical dike on opposite lateral sides of the door liner;

at least one mounting portion spaced apart from each dike and having at least one connecting portion to connect the mounting portion to the dike;

a shelf assembly that is removably securable to the at least one mounting portion, the shelf assembly comprising:

a food-retaining shelf portion; and a pair of end caps that retain the food-retaining shelf portion between them, each end cap adapted to releasably mount to one of the mounting portions.

2. The door retainer assembly of claim 1 wherein the end caps and shelf portion are one piece.

3. The door retainer assembly of claim 1 wherein:

the mounting portion further comprises a plate member disposed in a substantially parallel relation to the dike and defining a mounting portion space between the plate member and the dike; and the end caps each comprise a tab integrally formed therewith, the tab being shaped to be retained within the mounting portion space when the end caps are secured to the mounting portions.

4. The door retainer assembly of claim 3 wherein:

the liner further comprises a boss that projects away from the dike; and the end caps each further comprise a channel that is shaped to receive a boss when the end caps are secured to the mounting portions.

5. The door retainer assembly of claim 4 wherein the channel is formed of ridges that protrude outwardly from a surface of the end cap to define a substantially U-shaped channel.

6. The door retainer assembly of claim 5 wherein the channel includes at least one raised bump to restrict entry and exit of the boss from the channel.

7. The door retainer assembly of claim 4 wherein the boss projects from the mounting portion.

8. The door retainer assembly of claim 4 wherein the channel comprises a U-shape.

9. The door retainer assembly of claim 4 wherein the channel comprises a receiver with at least three sides.

10. The door retainer assembly of claim 9 wherein the channel is bounded by four sides.

11. The door retainer assembly of claim 9 wherein the receiver retains movement of the end cap when in place in substantially all but one direction.

12. The door retainer assembly of claim 3 wherein the tab comprises an elongated wall.

13. The door retainer assembly of claim 1 wherein the food-retaining shelf portion comprises a wire basket.

14. The door retainer assembly of claim 13 wherein the wire basket is retained between the end caps so that the wire basket is moveable tiltably with respect to the end caps.

15. The door retainer assembly of claim 13 wherein the wire basket is retained between the end caps in a non-moveable relation.

16. The door retainer assembly of claim 13 wherein each of the end caps comprise a substantially circular retaining recess and the wire basket comprises a protruding rod portion to reside within the retaining recess, the end caps being mountable to the wire basket by seating the protruding rod portions within the retaining recesses.

17. The door retainer assembly of claim 1 wherein the end caps each further comprise a plate portion having a forward-facing surface that overlies a portion of the dike when the end cap is secured to the mounting portions.

18. The door retainer assembly of claim 1 wherein the door liner further comprises a generally horizontally disposed ledge portion upon which the food-retaining shelf portion rests when the end caps are secured to the mounting portions.

19. The door retainer assembly of claim 1 wherein the vertical dike is of generally uniform thickness.

20. The door retainer assembly of claim 1 wherein the vertical dike extends substantially the full height of the liner.

21. The door retainer assembly of claim 1 wherein the mounting portion is integrally formed in the liner.

22. The door retainer assembly of claim 1 wherein the mounting portion comprises an elongated projection in the liner generally parallel to the dike but spaced from the dike to define the space between the dike and the mounting portion.

23. The door retainer assembly of claim 1 wherein to mounting portion is partially hollow in cross section.

24. The door retainer assembly of claim 1 wherein the connecting portion comprises an interface between the dike and the mounting portion.

25. The door retainer assembly of claim 1 wherein the connecting portion comprises a wall integrally formed with the dike.

26. The door retainer assembly of claim 1 wherein the connecting portion comprises a web.

27. The door retainer assembly of claim 26 wherein the web comprises connecting material between the mounting portion and the dike.

28. The door retainer assembly of claim 26 wherein the web comprises a junction between the mounting portion and the dike.

29. The door retainer assembly of claim 26 wherein the web comprises a built-up section to hold the mounting portion in fixed relation to the dike.

30. The door retainer assembly of claim 1 wherein the mounting portion is formed in the door liner.

31. The door retainer assembly of claim 1 wherein the connecting portion comprises a web.

32. The door retainer assembly of claim 1 wherein the dike has a substantially uniform thickness or width.

33. The door retainer assembly of claim 1 wherein the end cap snap fits to a mounting portion.

34. A door retaining assembly for retaining food items in a refrigerator unit comprising:

a door liner having a pair of generally vertical dikes;

at least one mounting portion located adjacent to each dike and comprising a substantially rectangular plate member that is connected to the dike by at least one connecting portion and defining a space between the plate member and the dike;

a shelf assembly that is removably securable to the mounting portions of the door liner, the shelf assembly comprising:

a food-retaining shelf portion;

a pair of end caps that retain the food-retaining shelf portion between them, the end caps being mountable to the mounting portions, the end caps each having a tab to reside within the space between the plate member and the dike when the end cap is secured to one of said mounting portions.

35. The door retaining assembly of claim 34 further comprising a boss on the liner, and each end cap further comprising a channel shaped receive the boss.

36. The door retainer assembly of claim 35 wherein the boss projects from the mounting portion.

37. The door retainer assembly of claim 35 wherein the channel comprises a U-shape.

38. The door retainer assembly of claim 35 wherein the channel comprises a receiver with at least three sides.

39. The door retainer assembly of claim 38 wherein the channel is bounded by four sides.

40. The door retainer assembly of claim 38 wherein the receiver retains movement of the end cap when in place in substantially all but one direction.

41. The door retaining assembly of claim 34 wherein the food-retaining shelf portion comprises a wire basket.

42. The door retaining assembly of claim 34 wherein the pair of end caps and food-retaining shelf are one piece.

43. The door retainer assembly of claim 34 wherein the vertical dike is of generally uniform thickness.

44. The door retainer assembly of claim 34 wherein the vertical dike extends substantially the full height of the liner.

45. The door retainer assembly of claim 34 wherein the mounting portion is integrally formed in the liner.

46. The door retainer assembly of claim 34 wherein the mounting portion comprises an elongated projection in the liner generally parallel to the dike but spaced from the dike to define the space between the dike and the mounting portion.

47. The door retainer assembly of claim 34 wherein the mounting portion is partially hollow in cross section.

48. The door retainer assembly of claim 34 wherein the connecting portion comprises an interface between the dike and the mounting portion.

49. The door retainer assembly of claim 34 wherein the connecting portion comprises a wall integrally formed with the dike.

50. The door retainer assembly of claim 34 wherein the connecting portion comprises a web.

51. The door retainer assembly of claim 50 wherein the web comprises connecting material between the mounting portion and the dike.

52. The door retainer assembly of claim 50 wherein the web comprises a junction between the mounting portion and the dike.

53. The door retainer assembly of claim 50 wherein the web comprises a built-up section to hold the mounting portion in fixed relation to the dike.

54. The door retainer assembly of claim 34 wherein the tab comprises an elongated wall.

55. The door retainer assembly of claim 34 wherein the mounting portion is formed in the door liner.

56. The door retainer assembly of claim 34 wherein the connecting portion comprises a web.

57. The door retainer assembly of claim 34 wherein the dike has a substantially uniform thickness or width.

58. The door retainer assembly of claim 34 wherein the end cap snap fits to a mounting portion.

59. An apparatus for releasably attaching a structure to a door liner of a door of a refrigerator unit, the door defining generally a plane, comprising:

(a) an end cap comprising (a1) a male member, and (a2) an interface for a food-retaining structure;

(b) a mounting portion formed in the door liner, the mounting portion defining (b1) a space having an entrance facing substantially outwardly of the plane of the door and configured to receive the male member of the end cap and restrain it from movement generally in the direction of the plane of the door;

(b2) the mounting portion having a relatively low profile in relationship to the door liner;

(c) a boss extending substantially from the dike, (d) the end cap further comprising a capture member having an interior space defined by a plurality of walls and an entrance, the capture member adapted to capture and resist exit of the boss when the end cap is mounted to the mounting portion and the boss passes through the entrance of the capture member, the capture member comprising a U-shaped member with the entrance adapted to be placed over the boss.

60. The apparatus of claim 59 wherein the interface comprises a pre-formed connection in the endcap adapted to receive a food-retaining portion of the structure.

61. The apparatus of claim 60 wherein the food-retaining structure is a shelf, a basket, or a retainer.

62. The apparatus of claim 59 wherein the interface is an integral junction with the food-retaining structure such that the end cap and the food-retaining structure is one piece.

63. The apparatus of claim 59 wherein the door liner comprises first and second vertical dikes and wherein the mounting portions are positioned at or near the vertical dikes respectively of the door liner.

64. The apparatus of claim 59 wherein the door liner comprises a top, a bottom and opposite sides each having a forwardmost surface, and the relatively low profile of the mounting portion does not extend beyond the forwardmost surface of the opposite side of the door liner adjacent to it.

65. The apparatus of claim 64 wherein the relatively low profile of the mounting portion does not extend substantially medially of the door liner.

66. The apparatus of claim 59 further comprising at least one raised portion on the interior of the U-shaped member such that the boss is snap-fit into the U-shaped member when moved sufficiently through the entrance.

67. The apparatus of claim 59 wherein the male member and the boss simultaneously can be inserted into the recess and capture member respectively when the end cap is installed on the mounting portion to support and hold the end cap against movement in any direction unless sufficient removing force in a removal direction is applied to release the capture member from the boss.

68. The apparatus of claim 59 wherein the capture member has a restricted cross-section into which the boss can be manually forced and to resist removal of the boss against release absent sufficient removing force in a removal direction.

69. The apparatus of claim 59 wherein the recess comprises a space bounded by walls on four sides.

70. The apparatus of claim 59 wherein the door liner has a top, bottom and opposite sides and the entrance to the recess is generally in an outward and topward direction.

71. A door retainer assembly for retaining items in a refrigerator unit comprising:

a door liner having a generally vertical dike on opposite lateral sides of the door liner and at least one mounting portion spaced apart from each dike, wherein the mounting portion includes at least one connecting portion to connect the mounting portion to the dike, the mounting portion comprising an elongated projection having one generally planar surface spaced from and facing the vertical dike to define a space therebetween;

a shelf assembly adapted for removeable securement to the at least one mounting portion of the door liner, the shelf assembly comprising a shelf portion and a pair of end caps that retain the shelf portion between them, each end cap adapted to releasably mount to one of said mounting portions, each end cap having a male member adapted to fit in the space between the mounting portion and the dike and having a receiver adapted to snap fit over a boss extending from the dike.

72. A door retaining assembly for retaining food items in a refrigerator unit comprising:

a door liner having a pair of generally vertical dikes and at least one mounting portion spaced apart from each dike, wherein the mounting portion includes a member having a generally flat surface facing but spaced apart from the dike and connected to the dike by at least one connecting portion wherein the mounting portion defines a space between the elongated member and the dike; and a shelf assembly that is removeably securable to the mounting portions, the shelf assembly comprising:

a shelf portion;

a pair of end caps that retain the shelf portion between them, the end caps being selectively mountable to the mounting portions of the door liner, the end caps each having a male member adapted to reside within the space by the mounting portion when the end cap is secured to the mounting portion; and a receiver adapted to receive a boss extended from the dike.

73. A refrigerator unit having a door retaining assembly for retaining food items, the door retaining assembly having the advantage of secure but reversible mounting of a food-retaining assembly to the refrigerator, the refrigerator unit comprising:

a body, a door, and a refrigeration system;

the door comprising a door liner having a generally vertical dike on opposite lateral sides of the door liner and a mounting portion located adjacent to each dike having at least one connecting portion to connect the mounting portion to the dike, the mounting portion comprising art elongated projection having one generally planar surface spaced from but facing the vertical dike to define a space therebetween;

a shelf assembly adapted for removeable securement to the mounting portions, the shelf assembly comprising a shelf portion and a pair of end caps that retain the shelf portion between them, each end cap adapted to releasably mount to a said mounting portion, each end cap having a male member adapted to fit in the space between the mounting portion and the dike and having a receiver adapted to snap fit over a boss extending from the dike.

74. A refrigerator unit having a door retaining assembly for retaining food items, the door retaining assembly having the advantage of secure but reversible mounting of a food-retaining assembly to the refrigerator, the refrigerator unit comprising:

a body, a door, and a refrigeration system;

a door liner having a pair of generally vertical dikes, a mounting portion located adjacent to each dike comprising a member having a generally flat surface facing but spaced apart from the dike and connected to the dike by at least one connecting portion, wherein the mounting portion defines a space between the elongated member and the dike;

a shelf assembly that is removeably securable to the door liner, the shelf assembly comprising:

a shelf portion;

a pair of end caps that retain the shelf portion between them, the end caps being selectively mountable to the mounting portions of the door liner, the end caps each having a male member adapted to reside within the space by the mounting portion when the end cap is secured to the mounting portion;

a receiver adapted to receive a boss extending from the dike.

* * * * *